US009631886B2

(12) United States Patent
Findlay

(10) Patent No.: US 9,631,886 B2
(45) Date of Patent: Apr. 25, 2017

(54) SPRUNG DROP PENDULUM

(71) Applicant: Smith & Wesson Corp., Springfield, MA (US)

(72) Inventor: David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 12 days.

(21) Appl. No.: 14/870,631

(22) Filed: Sep. 30, 2015

(65) Prior Publication Data

US 2017/0089654 A1 Mar. 30, 2017

(51) Int. Cl.

| | |
|---|---|
| ***F41A 19/13*** | (2006.01) |
| ***F41A 19/10*** | (2006.01) |
| ***F41A 19/12*** | (2006.01) |
| ***F41A 3/66*** | (2006.01) |
| ***F41A 19/16*** | (2006.01) |

(52) U.S. Cl.

CPC ..... *F41A 19/10* (2013.01); *F41A 3/66* (2013.01); *F41A 19/12* (2013.01); *F41A 19/13* (2013.01); *F41A 19/16* (2013.01)

(58) Field of Classification Search

CPC ..... F41A 19/10; F41A 19/12; F41A 19/13; F41A 19/16

USPC ..... 42/69.01, 69.02; 89/136, 153

See application file for complete search history.

(56) References Cited

U.S. PATENT DOCUMENTS

| | | | | |
|---|---|---|---|---|
| 2,274,195 A | | 2/1942 | Garrison | |
| 2,551,370 A | * | 5/1951 | Gartner | F41A 17/22 42/69.02 |
| 2,675,638 A | | 4/1954 | Crittendon | |
| 2,765,562 A | | 10/1956 | Roper et al. | |
| 2,856,718 A | | 10/1958 | Fischer | |
| 2,909,100 A | * | 10/1959 | Kennerley-Tayler | F41A 17/56 42/69.02 |
| 2,965,993 A | | 12/1960 | Perrine | |
| 3,234,679 A | | 2/1966 | Benson | |
| 3,270,456 A | | 9/1966 | Benson | |
| 3,370,374 A | | 2/1968 | Larsson | |
| 3,707,796 A | | 1/1973 | Bielfeldt | |
| 3,747,251 A | | 7/1973 | Baker | |
| 3,975,852 A | | 8/1976 | Findlay | |
| 4,301,609 A | | 11/1981 | Peterson et al. | |
| 4,897,951 A | | 2/1990 | Osborne | |

(Continued)

*Primary Examiner* — Stephen M Johnson

(74) *Attorney, Agent, or Firm* — John A. Chionchio; Ballard Spahr LLP

(57) ABSTRACT

A trigger assembly has a sear with a stop surface engageable with a reciprocating component for holding the reciprocating component in a cocked configuration. A trigger is movable into and out of engagement with the sear to hold and release the reciprocating component. A drop pendulum has a trigger cam engageable with the trigger. A spring acts between the trigger and the drop pendulum to bias the trigger cam into engagement with the trigger. The drop pendulum also has a head cam follower engageable with the reciprocating component. Motion of the reciprocating component acting through the head cam follower and the trigger cam forces the trigger to return to a configuration of engagement between the trigger and the sear. Use of the drop pendulum improves the stability of trigger mechanisms and effectively inhibits accidental discharge of firearms when subjected to inertial forces which occur when the firearm is dropped.

36 Claims, 5 Drawing Sheets

(56) References Cited

U.S. PATENT DOCUMENTS

| | | | | |
|---|---|---|---|---|
| 5,067,266 | A | 11/1991 | Findlay | |
| 5,373,775 | A | 12/1994 | Findlay et al. | |
| 5,697,178 | A | 12/1997 | Haskell | |
| 5,784,818 | A | 7/1998 | Otteson | |
| 5,857,280 | A | 1/1999 | Jewell | |
| 6,240,670 | B1 | 6/2001 | Findlay | |
| 6,553,706 | B1 | 4/2003 | Gancarz et al. | |
| 6,813,854 | B2 | 11/2004 | Popikow | |
| 7,188,561 | B1 * | 3/2007 | Kelbly | F41A 19/16 42/69.02 |
| 7,331,136 | B2 * | 2/2008 | Geissele | F41A 19/16 42/69.03 |
| 7,377,067 | B2 | 5/2008 | Werner | |
| 7,617,628 | B2 | 11/2009 | Curry | |
| 7,690,144 | B2 | 4/2010 | Fagundes de Campos | |
| 8,966,802 | B1 | 3/2015 | Findlay | |
| 2011/0277367 | A1 | 11/2011 | Krieger | |

* cited by examiner

SPRUNG DROP PENDULUM

FIELD OF THE INVENTION

This invention relates to an improved trigger mechanism for firearm fire control.

BACKGROUND

Trigger sensation (i.e., trigger pull weight, creep and feel) and safety are important issues in the operation of a firearm's fire control. Too often in the design of firearm fire control mechanisms, these two factors are seen as being in opposition to one another in that an increase in safety of operation comes at the expense of a decrease in trigger sensation and vice versa. However, it is both desirable and possible to improve both the safety and trigger sensation of firearms, using an improved trigger mechanism according to the invention disclosed in this specification that does not require a two-stage trigger feel found objectionable by many shooters.

SUMMARY

The invention concerns a trigger assembly for a firearm having a reciprocating component. In one example embodiment the trigger assembly comprises a sear movably mounted within the assembly. The sear has a stop surface engageable with the reciprocating component for holding the reciprocating component in a cocked configuration. The sear further comprises a contact surface. A trigger is movably mounted within the assembly. The trigger has an action surface movable into and out of engagement with the contact surface upon motion of the trigger. A drop pendulum is movably mounted within the assembly. The drop pendulum has a trigger cam engageable with the trigger. A pendulum spring is positioned between the trigger and the drop pendulum for biasing the trigger cam into engagement with the trigger.

In a particular example embodiment the trigger assembly comprises a head cam follower extending from the drop pendulum. The head cam follower is engageable with the reciprocating component such that motion of the reciprocating component acting through the head cam follower of the drop pendulum forces the trigger cam into engagement with the trigger, thereby forcing the trigger to return to a configuration of engagement between the action surface of the trigger and the contact surface of the sear.

Another example embodiment comprises a sear spring that biases the sear into a configuration of engagement between the action surface of the trigger and the contact surface of the sear. In another example embodiment, a trigger spring biases the trigger into a configuration of engagement between the action surface of the trigger and the contact surface of the sear. By way of example, the sear is pivotably mounted on a sear fulcrum.

In an example embodiment the stop surface is angularly oriented relatively to a line of motion of the reciprocating component to permit the reciprocating component to pivot the sear about the sear fulcrum into a configuration of disengagement between the action surface of the trigger and the contact surface of the sear upon motion of the reciprocating component along the line of motion against the stop surface.

In a further example, the trigger is pivotably mounted on a trigger fulcrum. By way of example, the pendulum spring has a line of action which is oriented perpendicular to a pivot axis of the trigger. In a further example, the line of action of the pendulum spring passes through the pivot axis of the trigger. Additionally by way of example, the drop pendulum is pivotably mounted on a drop pendulum fulcrum.

A particular example embodiment further comprises a receiver. The sear, the lever, the trigger and the drop pendulum are mounted within the receiver. In a specific example the sear fulcrum, the trigger fulcrum and the drop pendulum fulcrum each comprises a respective pin for pivotable mounting within the receiver.

The invention further encompasses a trigger assembly for a firearm having a receiver and a reciprocating component mounted on the receiver. In a specific example embodiment the trigger assembly comprises a sear pivotally mounted on the receiver. The sear has a stop surface engageable with the reciprocating component for holding the reciprocating component in a cocked configuration. The sear further comprises a contact surface. A trigger is pivotally mounted on the receiver. The trigger has an action surface movable into and out of engagement with the contact surface upon motion of the trigger. A drop pendulum is pivotally mounted on the receiver. The drop pendulum has a trigger cam engageable with the trigger. A pendulum spring is positioned between the trigger and the drop pendulum for biasing the trigger cam into engagement with the trigger.

A further example trigger assembly comprises a head cam follower extending from the drop pendulum. The head cam follower is engageable with the reciprocating component such that motion of the reciprocating component acting through the head cam follower of the drop pendulum forces the trigger cam into engagement with the trigger, thereby forcing the trigger to return to a configuration of engagement between the action surface of the trigger and the contact surface of the sear.

By way of further example, a sear spring is between the receiver and the sear and biasing the sear into a configuration of engagement between the action surface of the trigger and the contact surface of the sear. A specific example embodiment further comprises a trigger spring between the receiver and the sear and biasing the trigger into a configuration of engagement between the action surface of the trigger and the contact surface of the sear.

By way of example, the stop surface is angularly oriented relatively to a line of motion of the reciprocating component to permit the reciprocating component to pivot the sear into a configuration of disengagement between the action surface of the trigger and the contact surface of the sear upon motion of the reciprocating component along the line of motion against the stop surface. In a particular example embodiment, the pendulum spring has a line of action which is oriented perpendicular to a pivot axis of the trigger. By way of further example, the line of action of the pendulum spring passes through the pivot axis of the trigger.

The invention further encompasses a firearm. In one example embodiment the firearm comprises a reciprocating component and a trigger assembly comprising a sear movably mounted within the assembly. The sear has a stop surface engageable with the reciprocating component for holding the reciprocating component in a cocked configuration. The sear further comprises a contact surface. A trigger is movably mounted within the assembly. The trigger has an action surface movable into and out of engagement with the contact surface upon motion of the trigger. A drop pendulum is movably mounted within the assembly. The drop pendulum has a trigger cam engageable with the trigger. A pendulum spring is positioned between the trigger and the drop pendulum for biasing the trigger cam into engagement with the trigger.

A specific example of a firearm according to the invention further comprises a head cam follower extending from the drop pendulum. The head cam follower is engageable with the reciprocating component such that motion of the reciprocating component acting through the head cam follower of the drop pendulum forces the trigger cam into engagement with the trigger, thereby forcing the trigger to return to a configuration of engagement between the action surface of the trigger and the contact surface of the sear.

A particular example further comprises a sear spring biasing the sear into a configuration of engagement between the action surface of the trigger and the contact surface of the sear. Another example comprises a trigger spring biasing the trigger into a configuration of engagement between the action surface of the trigger and the contact surface of the sear. By way of example, the sear is pivotably mounted on a sear fulcrum. In a further example the stop surface is angularly oriented relatively to a line of motion of the reciprocating component to permit the reciprocating component to pivot the sear about the sear fulcrum into a configuration of disengagement between the action surface of the trigger and the contact surface of the sear upon motion of the reciprocating component along the line of motion against the stop surface.

In a specific example embodiment the trigger is pivotably mounted on a trigger fulcrum. By way of example, the pendulum spring has a line of action which is oriented perpendicular to a pivot axis of the trigger. In a specific example the line of action of the pendulum spring passes through the pivot axis of the trigger. In a further example, the drop pendulum is pivotably mounted on a drop pendulum fulcrum.

Further by way of example, the firearm comprises a receiver. The sear, the lever, the trigger and the drop pendulum are mounted within the receiver. In an example embodiment the sear fulcrum, the trigger fulcrum and the drop pendulum fulcrum each comprises a respective pin for pivotable mounting within the receiver. Another example comprises a receiver wherein sideplates comprise a portion of the receiver.

In a specific example embodiment the firearm comprises a bolt action rifle and the reciprocating component comprises a firing pin head. In another example the firearm comprises a semi-automatic rifle and the reciprocating member comprises a bolt carrier. In yet another example the firearm comprises an automatic rifle and the reciprocating member comprises a bolt carrier. By way of further example, the firearm comprises a pistol and the reciprocating member comprises a slide.

DETAILED DESCRIPTION

Figure 1:
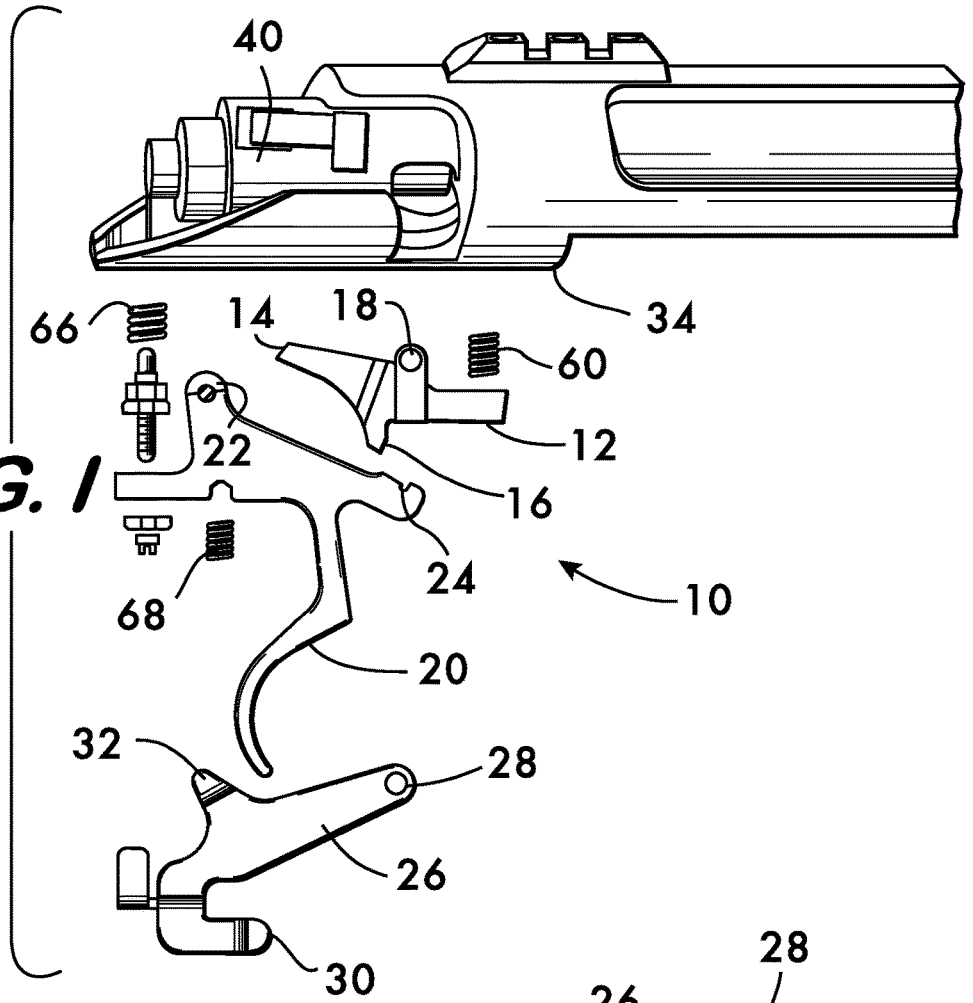
FIG. 1 is an exploded view of an example trigger assembly according to the invention along with a receiver and a reciprocating action.
Figure 1A:
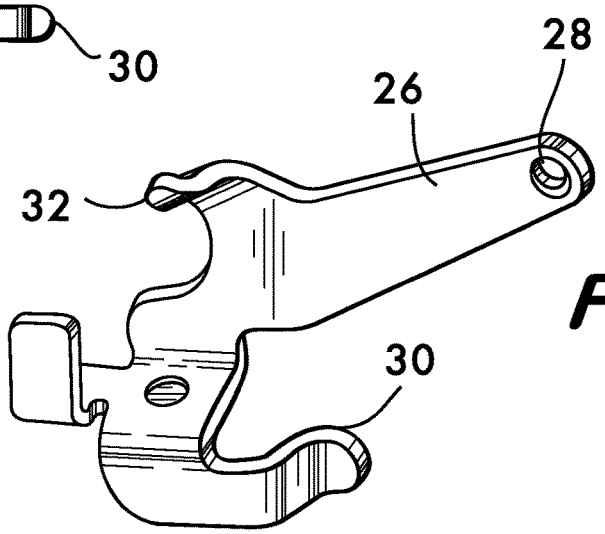
FIG. 1A is an isometric view of an example drop pendulum according to the invention.

FIG. 1 shows an exploded view of an example trigger assembly 10 according to the invention. Trigger assembly 10 comprises a sear 12 having a stop surface 14, a contact surface 16 and a fulcrum 18 about which the sear pivots. Trigger assembly 10 further includes a trigger 20 having a trigger fulcrum 22 and an action surface 24. Trigger assembly 10 also includes a drop pendulum 26. As shown in detail in FIG. 1A, the drop pendulum 26 comprises a fulcrum 28, a trigger cam 30 and a head cam follower 32.

Figure 2:
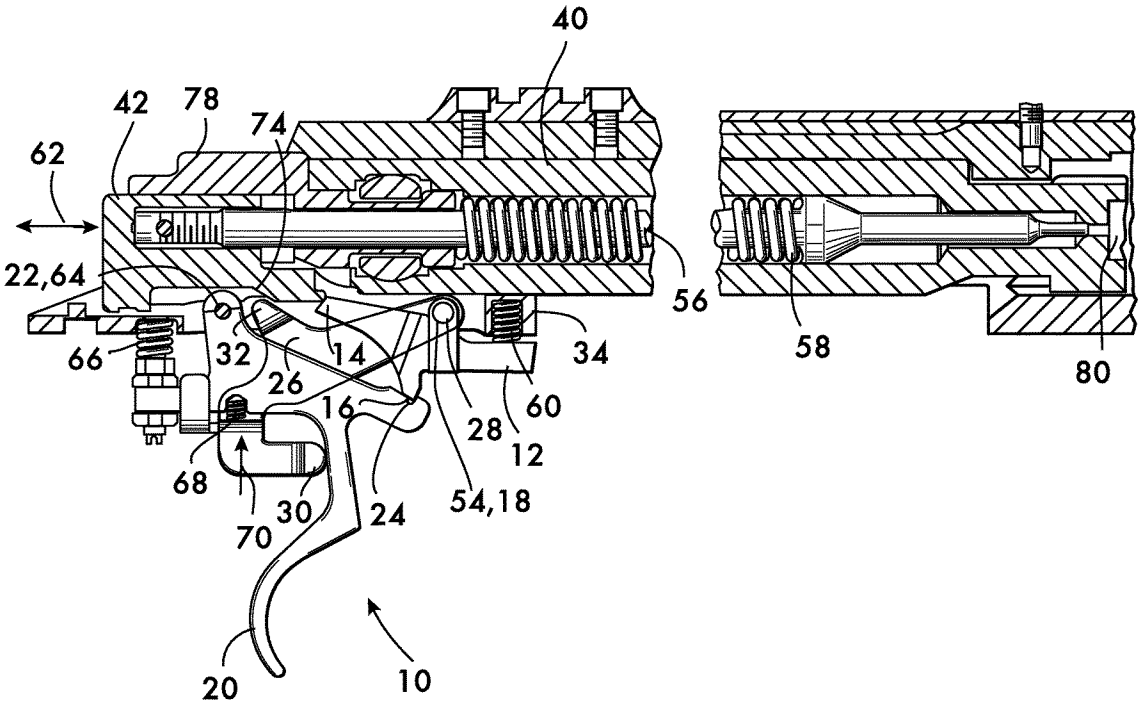
FIG. 2 is a partial longitudinal sectional view of the example trigger assembly shown in FIG. 1.
Figure 3:
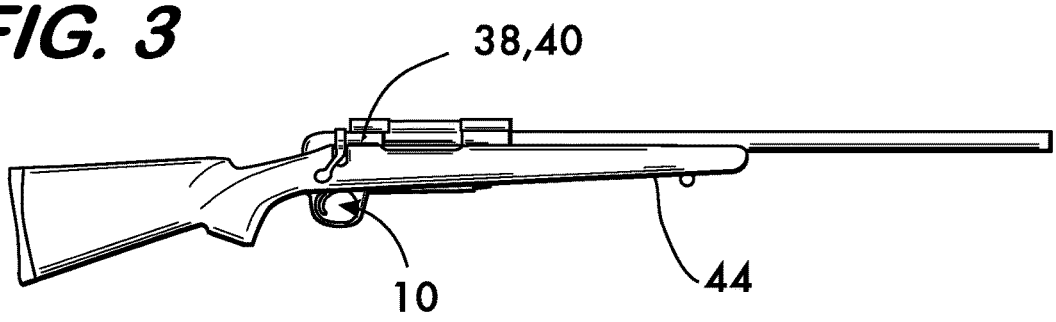
FIGS. 3-5 are side views of example firearms with which the trigger mechanism according to the invention may be used.
Figure 4:
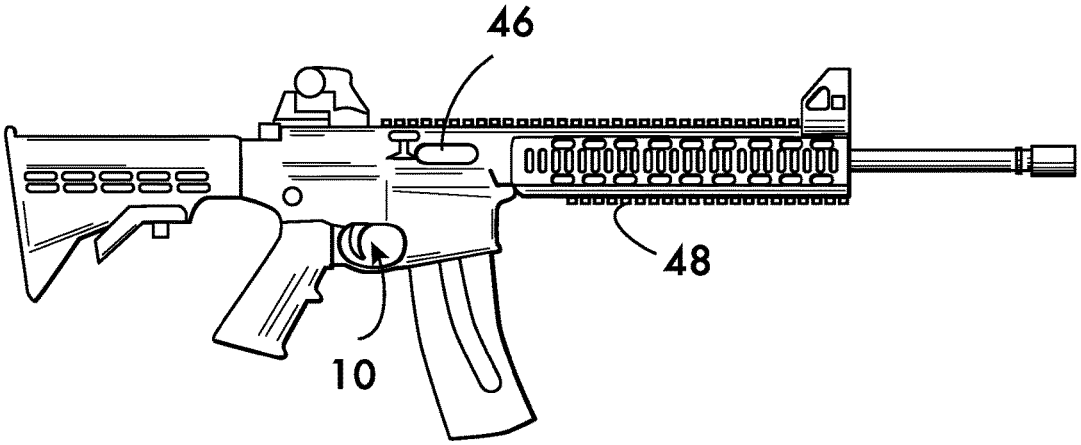
Figure 5:
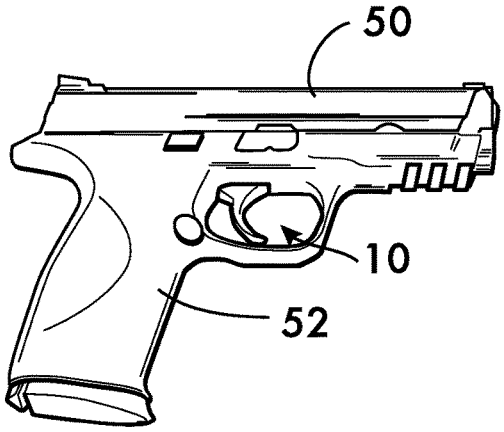

As shown in FIGS. 1 and 2, the trigger assembly 10 may be mounted within a receiver 34. In this example, as shown in FIG. 2, the receiver 34 is part of a bolt action 40. The bolt action 40 has a firing pin head 42 that comprises the reciprocating component of, for example, a bolt action rifle 44 of which the receiver 34 is a part (see FIG. 3). Other types of reciprocating components are also used with the trigger assembly 10, for example, the bolt carrier 46 of an automatic or semi-automatic firearm 48 (shown in FIG. 4) or the slide 50 of the semi-automatic pistol 52 shown in FIG. 5. Trigger assembly 10 may also be mounted between side plates of a firearm.

In the assembled view of trigger assembly 10 shown in FIG. 2, sear 12 is mounted on a pin 54 supported within the receiver 34. Sear pin 54 passes through the sear fulcrum 18 and permits pivoting motion of the sear 12 between a first position (shown), wherein the sear stop surface 14 engages and holds the firing pin head 42 in a cocked configuration, and a second position (shown in FIG. 6) wherein the stop surface 14 falls off of the firing pin head 42, thereby permitting the firing pin 56 to move toward the chamber 80 under the influence of firing pin spring 58 to strike the primer of a chambered round (not shown) and discharge the firearm. A sear spring 60 acts between the sear 12 and the receiver 34 to bias the sear into the first position. However, the stop surface 14 of sear 12 is angularly oriented relatively to the line of motion 62 of the firing pin head, and the biasing force of the sear spring 60 is selected relatively to the biasing force of the firing pin spring 58 such that if no other force is applied to the sear, the force between the firing pin head 42 and the sear 12, acting through the angularly oriented stop surface 14 will cause the sear 12 to pivot about its fulcrum 18 (compressing sear spring 60) and thereby release the firing pin head to move along its line of motion 62 and discharge the firearm. Pivoting motion of sear 12 that releases the firing pin head is counterclockwise about the fulcrum 18 in the view shown in FIG. 2.

The trigger 20 supplies the restraining force which prevents the sear 12 from counterclockwise pivoting until it is desired to discharge the firearm. As shown in FIG. 2, the trigger 20 is pivotably mounted on a trigger pin 64 that passes through the trigger fulcrum 22 and is supported within the receiver 34. The trigger action surface 24 is shown engaging the contact surface 16 of the sear 12. Engagement between trigger action surface 24 and sear contact surface 16 prevents the sear 12 from pivoting from the first to the second position under the biasing force of firing pin spring 58. Pulling the trigger 20 causes it to pivot (clockwise in this view) about its fulcrum 22 thereby disengaging the trigger action surface 24 from the sear contact surface 16 and releasing the restraining force on the sear 12. The sear then pivots counterclockwise, its stop surface 14 falls off of the firing pin head 42 and the firearm discharges (see FIG. 6). A trigger spring 66 acts between the receiver 34 and the trigger 20 and biases the trigger in the counterclockwise direction to maintain the trigger action surface 24 in engagement with the sear contact surface 16. The biasing force of the trigger spring 66 is selected so that the trigger pull (i.e., the force required to pull the trigger and discharge the firearm) is acceptable (i.e. not too high) while also maintaining sufficient stability of the trigger assembly 10 so as to prevent accidental discharge of the firearm under inertial forces, for example, if the firearm is dropped.

It is found that stability of the trigger assembly 10 is improved through the effects of the drop pendulum 26. As shown in FIG. 2, the pendulum 26 is pivotably mounted on sear pin 54, the pin passing through the pendulum fulcrum 28. Although the sear pin is used to mount the pendulum 26 in this example, it is understood that the pendulum could be mounted on its own pin as well. As further shown in FIG. 2, the trigger cam 30 extending from the pendulum 26 engages the trigger 20 relative to its fulcrum 22 so that the mass of the pendulum is added to the mass of the trigger to inhibit clockwise motion of the trigger and thereby counter inertial forces that may cause accidental discharge. Note that for inertial forces resulting from the firearm being dropped muzzle end down or trigger (bottom) down, the tendency of the pendulum 26 to pivot counterclockwise about its fulcrum 28 under the resultant inertial force counters any tendency of the trigger 20 to pivot clockwise and release the sear 12. For drops with the butt end down it is found effective to position a pendulum spring 68 between the trigger 20 and the drop pendulum 26. Pendulum spring 68 biases the trigger cam 30 into engagement with the trigger, and helps maintain the desired inertial cooperation between the pendulum 26 and the trigger 20 so as to inhibit clockwise motion of the trigger during a butt end down drop. While the presence of pendulum spring 68 increases the trigger pull, this effect can be controlled to an acceptable level by selecting the proper spring stiffness and orienting the line of action 70 of the pendulum spring so that it is perpendicular to the pivot axis defined by fulcrum 22 of the trigger 20. It is expected that advantage may be secured by having the spring line of action 70 pass close to or through the trigger pivot axis, fulcrum 22.

As shown in FIG. 2, the head cam follower 32 that extends from pendulum 26 is positioned so that it can engage a cam surface 74 on the firing pin head 42. As described below, interaction between the cam surface 74 and the head cam follower 32 helps to restore the trigger action surface 24 into engagement with the sear contact surface 16 by pivoting the trigger 20 when the firing pin head 42 reciprocates during operation of the firearm.

Operation of the trigger assembly 10 is described with reference to FIGS. 2, 6 and 7. As shown in FIG. 2, the firearm is ready to fire. The firing pin head 42 (i.e., the reciprocating component in this example) is held in the cocked position (i.e., firing pin spring 58 compressed between the firing pin 56 and the firearm's tail piece 78) by the stop surface 14 of sear 12 engaging the firing pin head 42. In this state, the firing pin 56 is prevented from moving toward the chamber 80 by the sear 12. Sear 12 is prevented from rotating counterclockwise about its fulcrum 18 because the action surface 24 of trigger 20 engages the contact surface 16 of the sear 12. Trigger cam 30 of drop pendulum 26 rests on the trigger 20, biased there against by pendulum spring 68.

Figure 6:
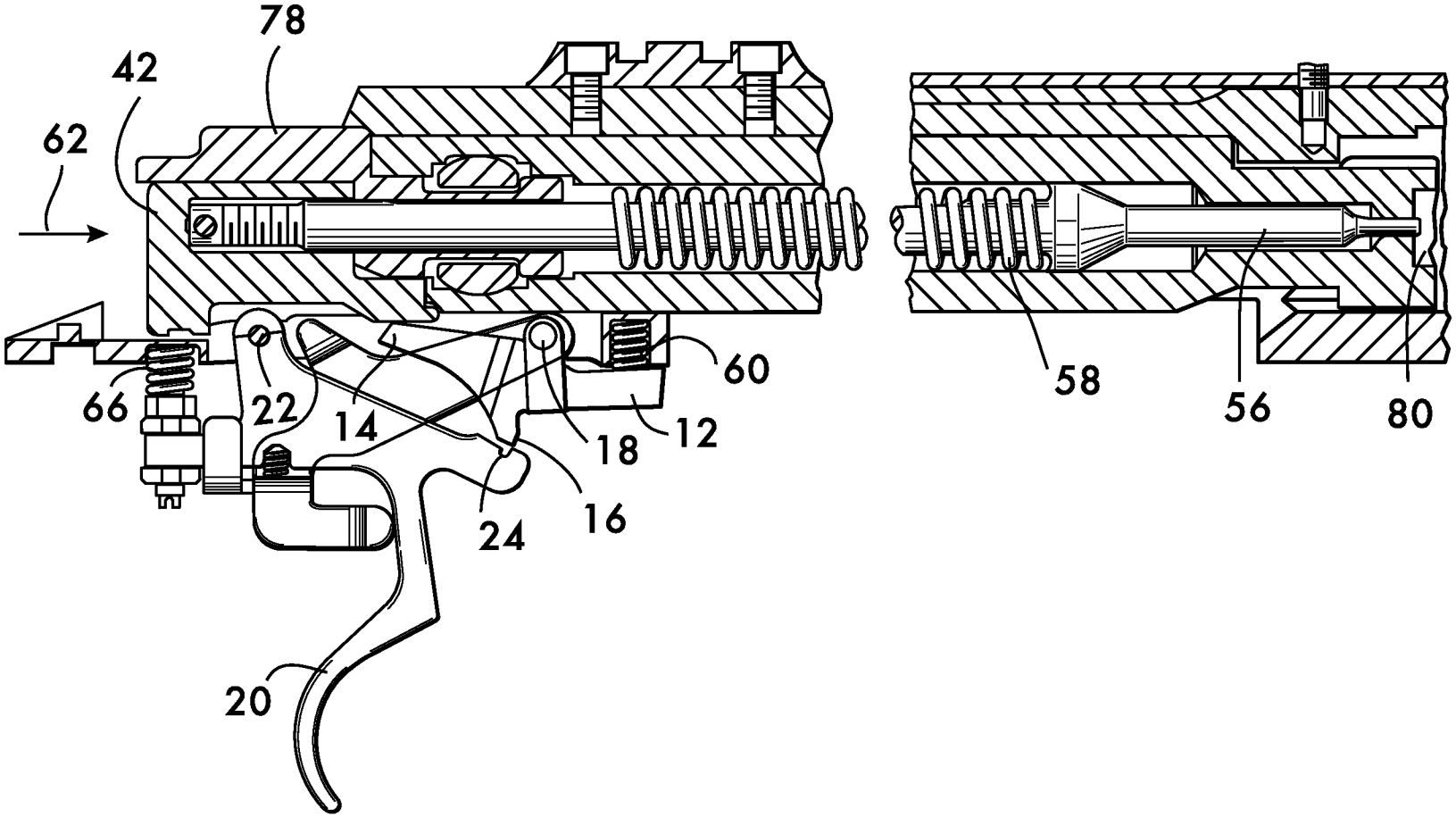
FIGS. 6 and 7 are partial longitudinal sectional views illustrating operation of the trigger mechanism of FIG. 1 in a bolt action rifle.

As shown in FIG. 6, a pull of trigger 20 rotates the trigger clockwise about trigger fulcrum 22 and disengages its action surface 24 from the contact surface 16 of the sear 12. Sear 12 is forced to rotate counterclockwise about its fulcrum 18 under the action of the force of the firing pin spring 58 acting through engagement between the firing pin head 42 and the angled stop surface 14 of sear 12. Counterclockwise rotation of the sear 12 causes the stop surface 14 to fall off of the firing pin head 42. This permits the firing pin head 42 to move along its line of motion 62 under the force of firing pin spring 58. Firing pin 56 is thus driven toward chamber 80 to discharge a chambered round (not shown).

Figure 7:
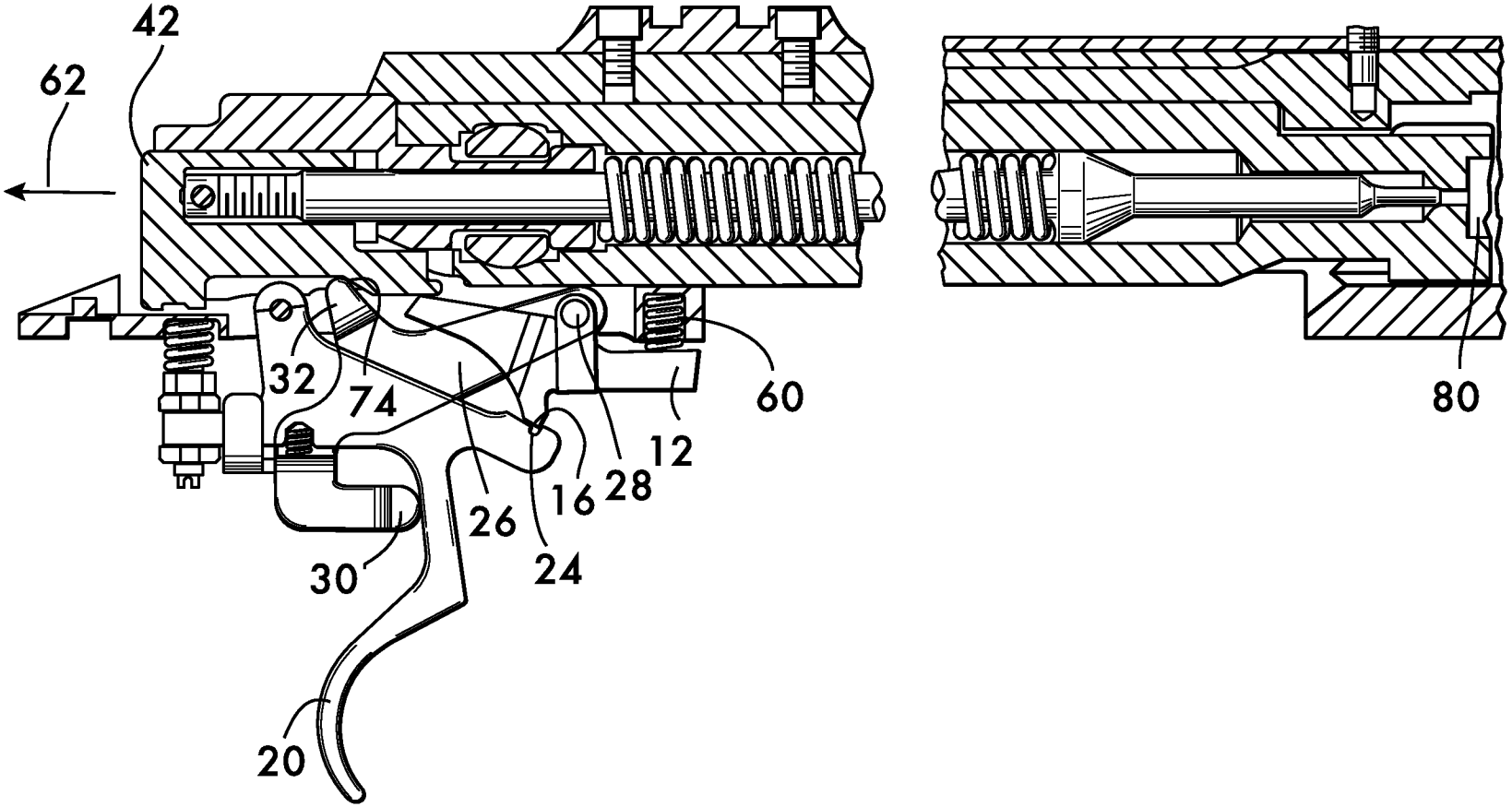

As shown in FIG. 7, the firing pin head 42 is drawn along its line of motion 62 away from chamber 80. For the bolt action rife (FIG. 3) this is accomplished by rotating the bolt to unlock it from the barrel and manually pulling the bolt away from the chamber. Motion of the bolt away from chamber 80 extracts the spent cartridge from the chamber and opens the action of the rifle, allowing another round to be chambered. As the firing pin head moves along its line of motion 62 away from the chamber 80 the cam surface 74 of firing pin head 42 engages the head cam follower 32 on the drop pendulum 26. Engagement between the cam surface 74 and the head cam follower 32 causes the drop pendulum 26 to rotate counterclockwise about its fulcrum 28. During rotation of the drop pendulum 26, the trigger cam 30 engages the trigger 20, causing it to rotate counterclockwise to bring its action surface 24 into engagement with the contact surface 16 of the sear 12. Note that this engagement is facilitated by the action of sear spring 60. Once the action and contact surfaces are engaged, the sear 12 is stable, and, until the trigger is again pulled, able to reliably hold the firing pin head 42 in the cocked position of FIG. 2. The bolt is then moved toward the chamber 80, chambering the next round, the trigger assembly 10 being in the configuration of FIG. 2, ready to fire. Motion of firing pin head 42 along its line of motion 62 causes trigger 20 and sear 12 to be brought into engagement through each motion of opening and closing the bolt.

Use of the drop pendulum 26 has been shown to improve the stability of trigger mechanisms and effectively inhibit accidental discharge of firearms when subjected to inertial forces which occur when the firearm is dropped.

What is claimed is:

1. A trigger assembly for a firearm having a reciprocating component, said trigger assembly comprising:

a sear movably mounted within said assembly, said sear having a stop surface engageable with said reciprocating component for holding said reciprocating component in a cocked configuration, said sear further comprising a contact surface;

a trigger movably mounted within said assembly, said trigger having an action surface movable into and out of engagement with said contact surface upon motion of said trigger;

a drop pendulum movably mounted within said assembly and moving during operation of said firearm, said drop pendulum having a trigger cam engageable with said trigger;

a pendulum spring positioned between said trigger and said drop pendulum for biasing said trigger cam into engagement with said trigger.

2. The trigger assembly according to claim 1, further comprising:

a head cam follower extending from said drop pendulum, said head cam follower being engageable with said reciprocating component; wherein motion of said reciprocating component acting through said head cam follower of said drop pendulum forces said trigger cam into engagement with said trigger, thereby forcing said trigger to return to a configuration of engagement between said action surface of said trigger and said contact surface of said sear.

3. The trigger assembly according to claim 1, further comprising a sear spring biasing said sear into a configuration of engagement between said action surface of said trigger and said contact surface of said sear.

4. The trigger assembly according to claim 1, further comprising a trigger spring biasing said trigger into a configuration of engagement between said action surface of said trigger and said contact surface of said sear.

5. The trigger assembly according to claim 1, wherein said sear is pivotably mounted on a sear fulcrum.

6. The trigger assembly according to claim 5, wherein said stop surface is angularly oriented relatively to a line of motion of said reciprocating component to permit said reciprocating component to pivot said sear about said sear fulcrum into a configuration of disengagement between said action surface of said trigger and said contact surface of said sear upon motion of said reciprocating component along said line of motion against said stop surface.

7. The trigger assembly according to claim 5, wherein said trigger is pivotably mounted on a trigger fulcrum.

8. The trigger assembly according to claim 7, wherein said pendulum spring has a line of action which is oriented perpendicular to a pivot axis of said trigger.

9. The trigger assembly according to claim 8, wherein said line of action of said pendulum spring passes through said pivot axis of said trigger.

10. The trigger assembly according to claim 7, wherein said drop pendulum is pivotably mounted on a drop pendulum fulcrum.

11. The trigger assembly according to claim 10, further comprising a receiver, said sear, said lever, said trigger and said drop pendulum being mounted within said receiver.

12. The trigger assembly according to claim 11, wherein said sear fulcrum, said trigger fulcrum and said drop pendulum fulcrum each comprises a respective pin for pivotable mounting within said receiver.

13. A trigger assembly for a firearm having a receiver and a reciprocating component mounted on said receiver, said trigger assembly comprising:

a sear pivotally mounted on said receiver, said sear having a stop surface engageable with said reciprocating component for holding said reciprocating component in a cocked configuration, said sear further comprising a contact surface;

a trigger pivotally mounted on said receiver, said trigger having an action surface movable into and out of engagement with said contact surface upon motion of said trigger;

a drop pendulum pivotally mounted on said receiver and pivoting during operation of said firearm, said drop pendulum having a trigger cam engageable with said trigger;

a pendulum spring positioned between said trigger and said drop pendulum for biasing said trigger cam into engagement with said trigger.

14. The trigger assembly according to claim 13, further comprising:

a head cam follower extending from said drop pendulum, said head cam follower being engageable with said reciprocating component; wherein motion of said reciprocating component acting through said head cam follower of said drop pendulum forces said trigger cam into engagement with said trigger, thereby forcing said trigger to return to a configuration of engagement between said action surface of said trigger and said contact surface of said sear.

15. The trigger assembly according to claim 13, further comprising a sear spring between said receiver and said sear and biasing said sear into a configuration of engagement between said action surface of said trigger and said contact surface of said sear.

16. The trigger assembly according to claim 13, further comprising a trigger spring between said receiver and said sear and biasing said trigger into a configuration of engagement between said action surface of said trigger and said contact surface of said sear.

17. The trigger assembly according to claim 13, wherein said stop surface is angularly oriented relatively to a line of motion of said reciprocating component to permit said reciprocating component to pivot said sear into a configuration of disengagement between said action surface of said trigger and said contact surface of said sear upon motion of said reciprocating component along said line of motion against said stop surface.

18. The trigger assembly according to claim 13, wherein said pendulum spring has a line of action which is oriented perpendicular to a pivot axis of said trigger.

19. The trigger assembly according to claim 18, wherein said line of action of said pendulum spring passes through said pivot axis of said trigger.

20. A firearm, said firearm comprising:

a reciprocating component;

a trigger assembly comprising:

a sear movably mounted within said assembly, said sear having a stop surface engageable with said reciprocating component for holding said reciprocating component in a cocked configuration, said sear further comprising a contact surface;

a trigger movably mounted within said assembly, said trigger having an action surface movable into and out of engagement with said contact surface upon motion of said trigger;

a drop pendulum movably mounted within said assembly and moving during operation of said firearm, said drop pendulum having a trigger cam engageable with said trigger;

a pendulum spring positioned between said trigger and said drop pendulum for biasing said trigger cam into engagement with said trigger.

21. The firearm according to claim 20, further comprising:

a head cam follower extending from said drop pendulum, said head cam follower being engageable with said reciprocating component; wherein motion of said reciprocating component acting through said head cam follower of said drop pendulum forces said trigger cam into engagement with said trigger, thereby forcing said trigger to return to a configuration of engagement between said action surface of said trigger and said contact surface of said sear.

22. The firearm according to claim 20, further comprising a sear spring biasing said sear into a configuration of engagement between said action surface of said trigger and said contact surface of said sear.

23. The firearm according to claim 20, further comprising a trigger spring biasing said trigger into a configuration of engagement between said action surface of said trigger and said contact surface of said sear.

24. The firearm according to claim 20, wherein said sear is pivotably mounted on a sear fulcrum.

25. The firearm according to claim 24, wherein said stop surface is angularly oriented relatively to a line of motion of said reciprocating component to permit said reciprocating component to pivot said sear about said sear fulcrum into a configuration of disengagement between said action surface of said trigger and said contact surface of said sear upon motion of said reciprocating component along said line of motion against said stop surface.

26. The firearm according to claim 24, wherein said trigger is pivotably mounted on a trigger fulcrum.

27. The firearm according to claim 26, wherein said pendulum spring has a line of action which is oriented perpendicular to a pivot axis of said trigger.

28. The firearm according to claim 27, wherein said line of action of said pendulum spring passes through said pivot axis of said trigger.

29. The firearm according to claim 24, wherein said drop pendulum is pivotably mounted on a drop pendulum fulcrum.

30. The firearm according to claim 29, further comprising a receiver, said sear, said lever, said trigger and said drop pendulum being mounted within said receiver.

31. The firearm according to claim 30, wherein said sear fulcrum, said trigger fulcrum and said drop pendulum fulcrum each comprises a respective pin for pivotable mounting within said receiver.

32. The firearm according to claim 31, further comprising a receiver wherein sideplates comprise a portion of said receiver.

33. The firearm according to claim 20, wherein said firearm comprises a bolt action rifle and said reciprocating component comprises a firing pin head.

34. The firearm according to claim 20, wherein said firearm comprises a semi-automatic rifle and said reciprocating member comprises a bolt carrier.

35. The firearm according to claim 20, wherein said firearm comprises an automatic rifle and said reciprocating member comprises a bolt carrier.

36. The firearm according to claim 20, wherein said firearm comprises a pistol and said reciprocating member comprises a slide.

* * * * *